US005334469A

United States Patent [19]

Sutton et al.

[11] Patent Number: 5,334,469

[45] Date of Patent: Aug. 2, 1994

[54] PHOTOGRAPHIC PROCESSES FOR PRODUCING SPECTRAL IMAGE RECORDS RETRIEVABLE BY SCANNING

[75] Inventors: James E. Sutton, Rochester; John Gasper, Hilton; Allen K. Tsaur, Fairport; Ann Tarn, Pittsford, all of N.Y.

[73] Assignee: Eastman Kodak Company, Rochester, N.Y.

[21] Appl. No.: 93,124

[22] Filed: Jul. 16, 1993

Related U.S. Application Data

[62] Division of Ser. No. 982,358, Nov. 27, 1992, Pat. No. 5,300,413.

[51] Int. Cl.[5] ..... G03C 11/00; G03C 7/00; G03C 5/22; G03C 1/46

[52] U.S. Cl. ..... 430/21; 430/357; 430/359; 430/363; 430/365; 430/367; 430/430; 430/503; 430/945

[58] Field of Search ..... 430/21, 357, 359, 363, 430/367, 430, 503, 945, 358, 365

[56] References Cited

U.S. PATENT DOCUMENTS

| | | | |
|---|---|---|---|
| 4,439,520 | 3/1984 | Kofron et al. | 430/434 |
| 4,543,308 | 9/1985 | Schumann et al. | 430/21 |
| 4,619,892 | 10/1986 | Simpson et al. | 430/505 |
| 4,777,102 | 10/1988 | Levine | 430/21 |
| 4,788,131 | 11/1988 | Kellogg et al. | 430/394 |
| 4,797,354 | 1/1989 | Saitou et al. | 430/567 |
| 4,985,350 | 1/1991 | Ikeda et al. | 430/567 |
| 5,057,409 | 10/1991 | Suga | 430/567 |
| 5,096,806 | 3/1992 | Nakamura et al. | 430/567 |
| 5,147,771 | 9/1992 | Tsaur et al. | 430/567 |
| 5,147,772 | 9/1992 | Tsaur et al. | 430/567 |
| 5,147,773 | 9/1992 | Tsaur et al. | 430/567 |
| 5,171,659 | 12/1992 | Tsaur et al. | 430/567 |
| 5,210,013 | 5/1993 | Tsaur et al. | 430/637 |
| 5,236,817 | 8/1993 | Kim et al. | 430/503 |
| 5,250,403 | 10/1993 | Antoniades et al. | 430/503 |
| 5,272,048 | 12/1993 | Kim et al. | 430/503 |

FOREIGN PATENT DOCUMENTS

| | | | |
|---|---|---|---|
| 451699 | 8/1936 | United Kingdom | 430/365 |
| 1458370 | 12/1976 | United Kingdom . | |

OTHER PUBLICATIONS

Buhr et al., Research Disclosure, May 1985, No. 25330.

*Primary Examiner*—Charles L. Bowers, Jr.
*Assistant Examiner*—J. Pasterczyk
*Attorney, Agent, or Firm*—Carl O. Thomas

[57] ABSTRACT

A method is disclosed of extracting two or more spectral image records from an imagewise exposed multicolor photographic element containing a plurality of tabular grain emulsions for individually recording imagewise exposure in at least two different regions of the visible spectrum. In each of the tabular grain emulsions tabular grains exhibiting a mean equivalent circular diameter of greater than 0.4 micrometer and a mean thickness of less than 0.2 micrometer account for greater than 90 percent of total grain projected area. No more than one of the tabular grain emulsions exhibits a mean tabular grain thickness of less than 0.07 micrometers, and each of tile remaining tabular grain emulsions exhibit a coefficient of variation of tabular grain thickness of less than 15 percent. The mean tabular grain thickness of emulsions for recording imagewise exposure to different regions of the visible spectrum differs by at least 0.02 micrometer. The imagewise exposed element is photographically processed to develop silver halide grains as a function of exposure and to remove developed silver. The processed photographic element is scanned in a first spectral wavelength region at which the tabular grains in a first of the emulsions reflect to a greater degree than the tabular grains of any emulsion which has recorded imagewise exposure in a different region of the spectrum, and the processed photographic element is also scanned in a second spectral wavelength region within which the tabular grains in a second of the emulsions reflect.

8 Claims, 5 Drawing Sheets

PHOTOGRAPHIC PROCESSES FOR PRODUCING SPECTRAL IMAGE RECORDS RETRIEVABLE BY SCANNING

This is a divisional of application Ser. No. 07/982,358, filed Nov. 27, 1992, U.S. Pat. No. 5,300,413.

FIELD OF THE INVENTION

The invention is directed to silver halide photographic elements of simplified construction capable of generating multiple image records and to a method of extracting the multiple image records following imagewise exposure and processing of the photographic element.

BACKGROUND

In classical black-and-white photography a photographic element containing a silver halide emulsion layer coated on a transparent film support is imagewise exposed to light. This produces a latent image within the emulsion layer. The film is then photographically processed to transform the latent image into a silver image that is a negative image of the subject photographed. Photographic processing involves developing (reducing silver halide grains containing latent image sites to silver), stopping development, and fixing (dissolving undeveloped silver halide grains). The resulting processed photographic element, commonly referred to as a negative, is placed between a uniform exposure light source and a second photographic element, commonly referred to as a photographic paper, containing a silver halide emulsion layer coated on a white paper support. Exposure of the emulsion layer of the photographic paper through the negative produces a latent image in the photographic paper that is a positive image of the subject originally photographed. Photographic processing of the photographic paper produces a positive silver image. The image bearing photographic paper is commonly referred to as a print.

In a well known, but much less common, variant of classical black-and-white photography a direct positive emulsion can be employed, so named because the first image produced on processing is a positive silver image, obviating any necessity of printing to obtain a viewable positive image. Another well known variation, commonly referred to as instant photography, involves imagewise transfer of silver ion to a physical development site in a receiver to produce a viewable transferred silver image.

In classical color photography the photographic film contains three superimposed silver halide emulsion layer units, one for forming a latent image corresponding to blue light (i.e., blue) exposure, one for forming a latent image corresponding to green exposure and one for forming a latent image corresponding to red exposure. During photographic processing developing agent oxidized upon reduction of latent image containing grains reacts to produce a dye image with silver being an unused product of the oxidation-reduction development reaction. Developed silver ($Ag^{\circ}$) is removed by bleaching during photographic processing. The image dyes are complementary subtractive primaries—that is, yellow, magenta and cyan dye images are formed in the blue, green and red recording emulsion layers, respectively. This produces negative dye images (i.e., blue, green and red subject features appear yellow, magenta and cyan, respectively). Exposure of color paper through the color negative followed by photographic processing produces a positive color print. Again, bleaching removes developed silver that would otherwise blacken the color print.

In one common variation of classical color photography reversal processing is undertaken to produce a positive dye image in the color film (commonly referred to as a slide, the image typically being viewed by projection). In another common variation, referred to as color image transfer or instant photography, image dyes are transferred to a receiver for viewing.

In each of the classical forms of photography noted above the final image is intended to be viewed by the human eye. Thus, the conformation of the viewed image to the subject image, absent intended aesthetic departures, is the criterion of photographic success.

With the emergence of computer controlled data processing capabilities, interest has developed in extracting the information contained in an imagewise exposed photographic element instead of proceeding directly to a viewable image. It is now common practice to extract the information contained in both black-and-white and color images by scanning. The most common approach to scanning a black-and-white negative is to record point-by-point or line-by-line the transmission of a near infrared beam, relying on developed silver to modulate the beam. In color photography blue, green and red scanning beams are modulated by the yellow, magenta and cyan image dyes. In a variant color scanning approach the blue, green and red scanning beams are combined into a single white scanning beam modulated by the image dyes that is read through red, green and blue filters to create three separate records. The records produced by image dye modulation can then be read into any convenient memory medium (e.g., an optical disk). The advantage of reading an image into memory is that the information is now in a form that is free of the classical restraints of photographic embodiments. For example, age degradation of the photographic image can be for all practical purposes eliminated. Systematic manipulation (e.g., image reversal, hue alteration, etc.) of the image information that would be cumbersome or impossible to achieve in a controlled and reversible manner in a photographic element are readily achieved. The stored information can be retrieved from memory to modulate light exposures necessary to recreate the image as a photographic negative, slide or print at will. Alternatively, the image can be viewed as a video display or printed by a variety of techniques beyond the bounds of classical photography—e.g., xerography, ink jet printing, dye diffusion printing, etc.

Hunt U.K. 1,458,370 illustrates a color photographic element constructed to have three separate color records extracted by scanning. Hunt employs a classical color film modified by the substitution of a panchromatic sensitized silver halide emulsion layer for the green recording emulsion layer. Following imagewise exposure and processing three separate records are present in the film, a yellow dye image recording blue exposure, a cyan dye image recording red exposure and a magenta dye image recording exposure throughout the visible spectrum. These three dye images are then used to derive blue, green and red exposure records, but the photographic element itself is not properly balanced to be used as a color negative is classically used for photographic print formation.

A number of other unusual film constructions have been suggested for producing photographic images intended to be extracted by scanning:

Kellogg et al U.S. Pat. No. 4,788,131 extracts image information from an imagewise exposed photographic element by stimulated emission from latent image sites of photographic elements held at extremely low temperatures. The required low temperatures are, of course, a deterrent to adopting this approach.

Levine U.S. Pat. No. 4,777,102 relies on the differential between accumulated incident and transmitted light during scanning to measure the light unsaturation remaining in silver halide grains after exposure. This approach is unattractive, since the difference in light unsaturation between a silver halide grain that has not been exposed and one that contains a latent image may be as low as four photons and variations in grain saturation can vary over a very large range.

Schumann et al U.S. Pat. No. 4,543,308 relies upon differentials in luminescence in developed and fixed color films to provide an image during scanning. Relying on differentials in luminescence from spectral sensitizing dye, the preferred embodiment of Schumann et al, is unattractive, since luminescence intensities are limited. Increasing spectral sensitizing dye concentrations beyond optimum levels is well recognized to desensitize silver halide emulsions.

Unusual silver halide photographic element constructions for producing images intended to be extracted by scanning have employed the same silver halide emulsions developed for classical black-and-white and color photography. The silver halide grain population of an emulsion can take a wide variety of forms. The silver halide grains themselves can take varied shapes. Regular grains, those free of internal stacking faults or screw dislocations, are typically cubes or octahedra, although rhombododecahedra and four additional rarely encountered regular geometric forms are known. Cubes are bounded entirely by {100} crystal faces; octahedra are bounded entirely by {111} crystal faces; and rhombododecahedra are bounded entirely by {110} crystal faces. There are a variety of grain structures that exhibit a combination of crystal faces lying in different crystal planes-e.g., tetradecahedra (a.k.a. cubo-octahedra) have six {100} crystal faces and eight {111} crystal faces. Emulsions prepared in an active ripening environment, such as ammoniacal emulsions, often have had the grain corners sufficiently rounded that the grains are essentially spherical. Many, if not most, silver halide grains found in photographic emulsions are not regular. Twinning is a common grain irregularity. Singly twinned grains are common. Tabular grains having {111} major faces are produced by two or three parallel twin planes. Multiply twinned grains are often of irregular shape and have on at least one occasion been descriptively referred to as "potato" grains. To complicate matters further, silver halide emulsions usually contain a mixture of grains of different sizes and shapes. Thus, nominal references to photographic silver halide emulsions embrace a large variety of silver halide grain populations.

Although tabular grains had been observed in silver bromide and bromoiodide photographic emulsions dating from the earliest observations of magnified grains and grain replicas, it was not until the early 1980's that photographic advantages, such as improved speed-granularity relationships, increased covering power both on an absolute basis and as a function of binder hardening, more rapid developability, increased thermal stability, increased separation of blue and minus blue imaging speeds, and improved image sharpness in both mono-and multi-emulsion layer formats, were realized to be attainable from "tabular grain" silver bromide and bromoiodide emulsions in which the majority (>50%) of the total grain population based on grain projected area is accounted for by tabular grains satisfying the mean tabularity relationship:

$$ECD/t^2 > 25$$

where

ECD is the equivalent circular diameter in micrometers (μm) of the tabular grains and t is the thickness in μm of the tabular grains. Once photographic advantages were demonstrated with tabular grain silver bromide and bromoiodide emulsions techniques were devised to prepare tabular grains containing silver chloride alone or in combination with other silver halides. Subsequent investigators have extended the definition of tabular grain emulsions to those in which the mean aspect ratio (ECD:t) of grains having parallel crystal faces is as low as 2:1. Photographic advantages attributable to the tabular grain shape can be realized with tabularities of greater than 8.

Although most tabular grain emulsion definitions require greater than 50 percent of the total grain projected area to be accounted for by tabular grains, tabular grain emulsions often contain significant unwanted grain populations and also exhibit a higher level of grain dispersity (ECD variance) than can be obtained by a well controlled precipitation of a regular grain emulsion. This has presented a continuing challenge to those preparing tabular grain emulsions.

A statistical technique for quantifying tabular grain dispersity that has been applied to both nontabular and tabular grain emulsions is to obtain a statistically significant sampling of the individual tabular grain projected areas, calculate the corresponding ECD of each grain, determine the standard deviation of the grain ECDs, divide the standard deviation of the grain population by the mean ECD of the grains sampled and multiply by 100 to obtain the size coefficient of variation, hereinafter referred to as COV(ECD), of the grain population as a percentage.

Kofron et al U.S. Pat. No. 4,439,520 illustrates tabular grain emulsion technology at the outset of its development in the early 1980's and multicolor photographic elements containing these emulsions.

Saitou et al U.S. Pat. No. 4,797,354 reports in its Examples tabular grain silver bromide emulsions with tabular grain projected areas of up to 93 percent. Of the tabular grain emulsions having a tabular grain projected area of greater than 90%, a mean ECD of at least 0.4 μm and a mean thickness of less than 0.2 μm the lowest COV(ECD) reported is 15.3%.

Nakamura et al U.S. Pat. No. 5,096,806 reports in Example 2 a tabular grain silver bromoiodide emulsion having a tabular grain projected area of 99.7%, a mean tabular grain thickness of 0.16 μm, a mean ECD of 1.1 μm. and grain COV(ECD) of 10.1%.

Tsaur et al U.S. Pat. Nos. 5,147,771, 5,147,772, 5,147,773 and 5,171,659 disclose processes of preparing tabular grains silver bromide and bromoiodide emulsions employing varied polyalkylene oxide block copolymer to reduce grain dispersity. Although no quantification is provided, Tsaur et al U.S. Pat. Nos. 5,147,771 and 5,171,659 are notable in observing qualitatively the reduced thickness variance of one of the tabular grain emulsions prepared.

Buhr et al Research Disclosure, Vol. 253, May 1985, Item 25330, presents in FIG. 1 a calculated correlation between sheet thicknesses of from 0.07 μm to 0.16 μm and reflectances at varied visible wavelengths. Based on the calculated reflectances of thin sheets Buhr et al suggests employing tabular grain emulsions for varied layers of a multicolor photographic element to minimize reflectance of light intended to be recorded by underlying emulsion layers or to maximize reflectance of blue light before it can reach one or more underlying emulsion layers and thereby contaminate a minus blue (green or red) image record.

RELATED PATENT APPLICATIONS

Tsaur et al U.S. Ser. No. 699,855, filed May 14, 1991, titled A VERY LOW COEFFICIENT OF VARIATION TABULAR GRAIN EMULSION now U.S. Pat. No. 5,210,013, commonly assigned, discloses a photographic emulsion containing a coprecipitated grain population exhibiting a COV(ECD) of less than 10 percent. The coprecipitated grain population consists essentially of tabular grains which are at least 50 mole percent bromide, based on silver, and which have a mean thickness in the range of from 0.080 to 0.3 μm, and a mean tabularity of greater than 8. In addition to reporting minimum COV(ECD) the emulsions of Tsaur et al are disclosed to exhibit low grain-to-grain variations in the thicknesses of the coprecipitated tabular grain population as evidenced by the low chromatic variances of light reflections from the tabular grain population. Tabular grain emulsions are reported in which the majority of the tabular grains are of one hue or closely related family of hues. From these observations it has been determined that the emulsions can be prepared with greater than 50 percent, preferably greater than 70 percent and optimally greater than 90 percent of the total tabular grain projected area exhibiting a hue indicative of thickness variations within ±0.01 μm of the mean tabular grain thickness.

Kim et al U.S. Ser. No. 846,306, filed Mar. 4, 1992, titled IMPROVED REVERSAL PHOTOGRAPHIC ELEMENTS CONTAINING TABULAR GRAIN EMULSIONS, now allowed, commonly assigned, discloses tabular grain emulsions similar to those of Tsaur et al U.S. Ser. No. 699,855, but with permissible COV(ECD) ranging up to 15 percent.

Kim et al U.S. Ser. No. 860,664, filed Mar. 30, 1992, titled TABULAR GRAIN EMULSION CONTAINING REVERSAL PHOTOGRAPHIC ELEMENTS EXHIBITING IMPROVED SHARPNESS IN UNDERLYING LAYERS now U.S. Pat. No. 5,236,817, commonly assigned, discloses tabular grain emulsions similar to those of Tsaur et al U.S. Ser. No. 699,855, but with the requirement that in an emulsion layer overlying a red or green recording emulsion layer of a reversal photographic element the tabular grains account for greater than 97 percent of total grain projected area.

Simons et al U.S. Ser. No. 905,053, filed Jul. 26, 1992, titled PROCESS FOR THE EXTRACTION OF SPECTRAL IMAGE RECORDS FROM DYE IMAGE FORMING PHOTOGRAPHIC ELEMENTS, now abandoned in favor of U.S. Ser. No. 966,623filed Oct. 26, 1992, commonly assigned, discloses a method of extracting independent spectral image records from an imagewise exposed photographic element that contains superimposed silver halide exposure recording layer units each containing a latent image derived from a selected region of the spectrum. The photographic element contains N+1 superimposed silver halide exposure recording units. Photographic processing is conducted to produce a silver image in N+1 of the exposure recording units and a dye image distinguishable from other dye images in at least N exposure recording layer units. The photographic element is in one instance scanned in a spectral region of silver absorption and minimal image dye absorption to provide a first image density record, and the photographic element is also scanned in N spectral regions wherein maximum density of a different image dye occurs to provide N additional image density records. Information from the separate image density records is converted to N+1 image records each corresponding to a different latent image in the exposed photographic element.

SUMMARY OF THE INVENTION

Figure 1:
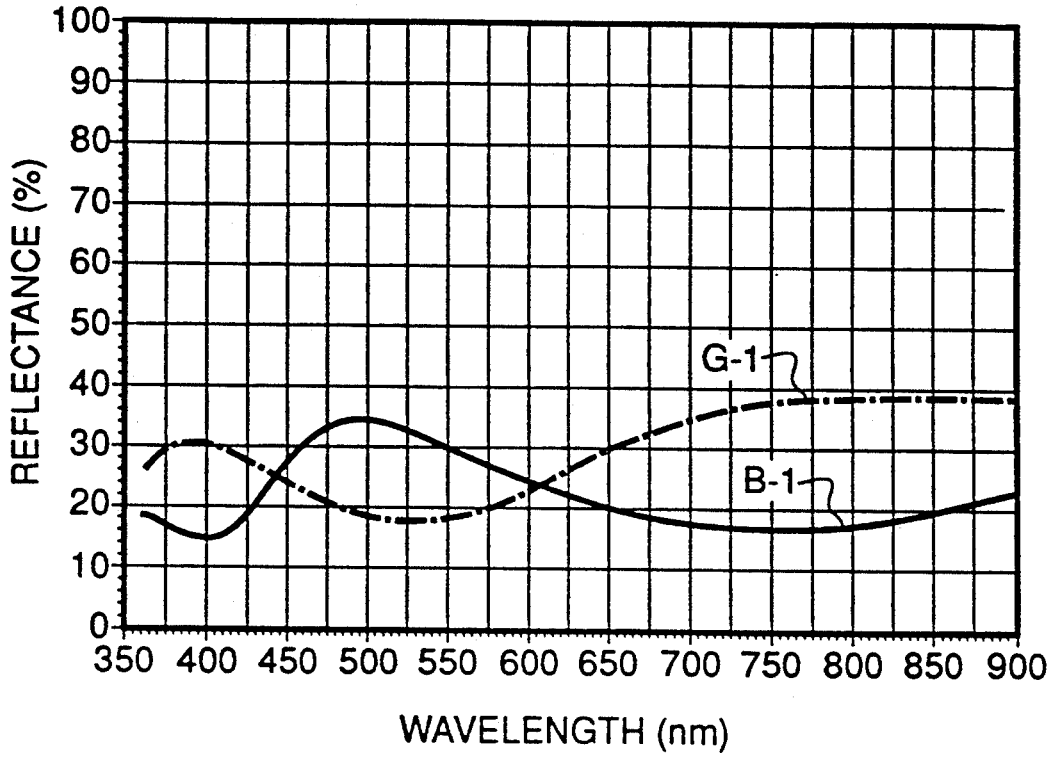
FIG. 1 is a plot of tabular grain reflectances in percent versus wavelength in nanometers (nm)

This invention has as its purpose to provide a novel approach for obtaining two or more spectral image records from a multicolor photographic element. This approach requires specific and novel selections of emulsion grain characteristics, but otherwise allows the multicolor photographic elements to be greatly simplified in construction. For example, by employing specific and novel selections of emulsion grain characteristics it is possible, but not required, to obtain two or more spectral image records (1) without forming a dye image within the multicolor photographic element, (2) without providing scavengers between or in emulsion layer units intended to record exposures to different portions of the spectrum, and (3) without even coating the emulsions intended to record exposures to different portions of the spectrum in separate layers.

In one aspect this invention is directed to a multicolor photographic element comprised of a support and, coated on the support, a plurality of tabular grain emulsions for individually recording imagewise exposure in at least two different regions of the visible spectrum, wherein in each of the tabular grain emulsions tabular grains exhibiting a mean equivalent circular diameter of greater than 0.4 micrometer and a mean thickness of less than 0.2 micrometer account for greater than 90 percent of total grain projected area, no more than one of the tabular grain emulsions exhibits a mean tabular grain thickness of less than 0.07 micrometers, each of the remaining tabular grain emulsions exhibits a coefficient of variation of tabular grain thickness of less than 15 percent, and the mean tabular grain thickness of emulsions for recording imagewise exposure to different regions of the visible spectrum differs by at least 0.02 micrometer.

In another aspect, this invention is directed to a method of extracting two or more spectral image records from an imagewise exposed multicolor photographic element having a support and, coated on the support, a plurality of tabular grain emulsions for individually recording imagewise exposure in at least two different regions of the visible spectrum, comprising the steps of (a) photographically processing the imagewise exposed photographic element to produce a detectable image in each tabular grain emulsion that can be spectrally distinguished from the detectable image in all other emulsions for recording in a different region of the spectrum and (b) scanning the processed photographic element in at least two different spectral regions and recording the images observed in the photographic element, wherein (1) in each of the tabular grain emulsions tabular grains exhibiting a mean equivalent circular diameter of greater than 0.4 micrometer and a mean thickness of less than 0.2 micrometer account for greater than 90 percent of total grain projected area, no more than one of the tabular grain emulsions exhibits a mean tabular grain thickness of less than 0.07 micrometers, each of the remaining tabular grain emulsions exhibits a coefficient of variation of tabular grain thickness of less than 15 percent, and the mean tabular grain thickness of emulsions for recording imagewise exposure to different regions of the visible spectrum differs by at least 0.02 micrometer, (2) during photographic processing silver halide grains are developed as a function of exposure and $Ag^{\circ}$ is thereafter removed from the photographic element without removing undeveloped silver halide grains, (3) the processed photographic element is scanned in a first spectral wavelength region at which the tabular grains in a first of the emulsions reflect to a greater degree than the tabular grains of any emulsion which has recorded imagewise exposure in a different region of the spectrum, and (4) the processed photographic element is also scanned in a second spectral wavelength region within which the tabular grains in a second of the emulsions reflect.

DESCRIPTION OF PREFERRED EMBODIMENTS

The invention is directed to a method of extracting two or more spectral image records from an imagewise exposed and processed multicolor photographic element containing two or more silver halide emulsions capable of recording exposure in a different region of the spectrum.

Whereas in classical color photography the differing reflection or transmission of light by image dyes of different hues in the blue, green and red recording layer units are relied upon to produce a viewable multicolor image, in the multicolor photographic elements of this invention distinguishable records of imagewise exposure to different regions of the spectrum are realized by relying on specific selections of tabular silver halide grains for recording exposures to different regions of the spectrum. Following imagewise exposure, development and removal of developed silver, an image pattern of tabular grains remains from each emulsion provided to record exposure within a different region of the spectrum. In the ideal case, which can only be approached in practice, within each emulsion the silver halide grains capable of responding to exposure consist of tabular grains of the same thickness. Therefore, all of the grains in the ideal emulsion exhibit the same wavelength dependent reflectances when scanned. In the ideal case the mean tabular grain thickness of each emulsion layer is chosen to permit maximum reflectance in a wavelength region which corresponds to the minimum or near minimum reflectance of all tabular grains in emulsions intended to record exposure to a different region of the spectrum. This involves selecting different tabular grain thicknesses for each emulsion intended to record exposure within a different region of the spectrum.

Each image pattern of tabular grains corresponding to exposure in a different region of the spectrum remaining in the photographic element after processing can be selectively recorded by reflection or transmission scanning. In the ideal case each spectral image record is produced by scanning in the wavelength region of maximum reflectance of tabular grains of one thickness and minimal or near minimal reflectance by tabular grains differing in thickness.

Deferring for the moment consideration of the tabular grain requirements, the multicolor photographic elements of the invention are noteworthy in their simplicity. Not only do the silver halide grains themselves form the latent image on exposure, they also alone constitute the image pattern observed during scanning. Unlike classical color photographic elements the multicolor photographic elements of this invention do not require any dye to be imagewise formed or removed from the photographic element. No vehicle for image dye or dye precursors, such as coupler solvent particles, is required. No oxidized developing agent scavenger is required either in the emulsions or in interlayers between the emulsions. Emulsions intended to record different regions of the spectrum need not be separated by any interlayer. It is, in fact, possible to dispense with coating emulsions intended to record in different regions of the spectrum in different layers. Emulsions intended to record in different regions of the spectrum can be present in a con, non coating layer. In the simplest construction only a single emulsion containing layer is required to form a multicolor photographic element satisfying the requirements of the invention. Except that emulsions capable of recording in at least two (and preferably three) regions of the spectrum are present, the structure of the multicolor photographic elements of this invention can be identical to that of black-and-white silver halide photographic elements. The multicolor photographic elements of this invention in their preferred forms are much more comparable to the relatively simple constructions of black-and-white photographic elements than the multicolor photographic elements of classical color photography. At the same time information retrieval by scanning, though working with a different information signal than has been heretofore employed, allows basically the same scanning approaches to be employed that have been developed for dye image containing multicolor photographic elements.

Notwithstanding the simplicity of the invention in other respects, the silver halide grain requirements of the invention are quite formidable. At present practical and attractive processes of producing emulsions in which the tabular grains of exactly the same thickness constitute the entire grain population, as postulated in the ideal case above, have not been developed. The fundamental departure from known film constructions and scanning techniques that this invention represents has been made possible by recent advances in tabular grain emulsion technology that have provided emulsions more closely approaching the ideal grain population postulated above and by the discovery of workable selections from among practically available tabular grain emulsions.

The multicolor photographic elements employ tabular grain emulsions in which tabular grains having an ECD of at least 0.4 μm account for greater than 90% (preferably >97% and ideally essentially all) of total grain projected area. The presence of nontabular grains is restricted, since nontabular grains fail to exhibit the spectrally selective reflectances required for the practice of the invention and they scatter light to a sufficient degree to degrade the desired reflectances from the required tabular grain population. Even tabular grains scatter light to some extent. By requiring the tabular grain population to have a mean ECD of greater than 0.4 μm the percentage of tabular grain projected area accounted for by light scattering tabular grain edges is held to a small fraction of total grain projected area. It is preferred that the tabular grains accounting for greater than 90% of total grain projected area have a mean ECD of at least 1.0 μm. As is well understood by those skilled in the art, photographically-useful tabular grain silver halide emulsions have mean ECDs of up to 10 μm, with mean tabular grain ECDs of from 1.0 to 5.0 μm being contemplated as being optimum for the practice of this invention.

The selection of the thickness of the tabular grains in each emulsion is based on the reflectance to be obtained from the tabular grains during scanning. To make tabular grain thickness selections it is then necessary to correlate wavelength range selections for scanning. The present invention contemplates scanning with electromagnetic radiation (also referred to as light) ranging from the ultraviolet through the visible spectrum and well into the near infrared spectrum. It is generally convenient to conduct scanning using wavelengths in the range of from about 300 to 900 nm.

In a preferred form of the invention the thickness of the tabular grains of each emulsion intended to record imagewise exposure to the same wavelength region of the spectrum is chosen to reflect light received during one scan to a greater degree than the tabular grains of the remaining emulsion or emulsions which have recorded imagewise exposure in a different region of the spectrum. This is most advantageously realized by choosing the thickness of the tabular grains to exhibit maximum reflectance during the one scan. Buhr et al *Research Disclosure*, Vol. 253, May 1985, Item 25330, here incorporated by reference, discloses correlations between reflectance and wavelength as a function of sheet thicknesses.

It is contemplated that the tabular grains employed in the practice of the invention will in all instances have thicknesses of less than 0.2 μm. When tabular grain thicknesses exceed 0.2 μm, the peak intensity and spectral selectivity of reflectance is objectionably degraded. Further, it is generally otherwise photographically inefficient to employ tabular grains having thicknesses of greater than 0.2 μm.

In the preferred form of the invention it is also contemplated that the tabular grains in each emulsion have mean thicknesses of greater than 0.07 μm. When the mean thickness of the tabular grains within an emulsion is less than 0.07 μm (i.e., when the tabular grains are ultrathin), little variance in reflectance as a function of the wavelength of scanning is observed. It is preferred to select mean tabular grain thicknesses of each of the emulsions from within the range of from 0.08 to 0.18 μm. When a mean tabular grain thickness in this range is employed, it is possible to observe well defined maximum and minimum reflectances within the overall wavelength range of from 300 to 900 nm. Thus, a wavelength or wavelength region can be selected from the overall range that permits maximum or near maximum reflectance to be observed during one scan and minimum or near minimum reflectance to be observed during a second scan at a different wavelength or wavelength region within the overall scanning range.

As described in more detail below it is also possible to select tabular grains intended to record imagewise exposure in one region of the spectrum from among those having mean thicknesses of less than 0.07 μm (i.e., from among ultrathin tabular grains). Since ultrathin tabular grains exhibit little variance of reflectance as a function of scanning wavelengths, their reflectance is superimposed on the reflectance of each of the remaining tabular grain populations. By scanning the ultrathin tabular grains in a different wavelength region than the remaining tabular grain population or populations, it is possible to obtain mathematically a separate reflectance curve for the ultrathin tabular grains using the resolution procedure demonstrated in the Examples. This approach, however, is limited to employing ultrathin tabular grain emulsions to record exposure to no more than one region of the spectrum. When the ultrathin tabular grain emulsion is employed in combination with one other tabular grain emulsion, it is preferred to scan ultrathin tabular grains at a wavelength where the reflectance of the one other is minimal or near minimal. When the ultrathin tabular grain emulsion is employed in combination with two other tabular grain emulsions, it is preferred to scan the ultrathin tabular grains at a wavelength where the combined reflectances of the two other tabular grain emulsions are minimal or near minimal.

For each tabular grain emulsion having a mean tabular grain thickness of >0.07 μm intended to exhibit maximum or near maximum reflectance during one scan and minimum or near minimum reflectance during one or more other scans, it is essential that the tabular grains exhibit a low coefficient of variation of tabular grain thickness, hereinafter also designated as COV(t). The explanation above of COV(ECD) applies to COV(t), the only difference being that tabular grain thickness replaces tabular grain ECD as the parameter of interest. If COV(t) of the tabular grains in an emulsion are not restricted, maximum reflectances in one wavelength region are reduced and minimum reflectances in another wavelength region are increased, complicating or rendering impossible signal discrimination from different tabular grain emulsions. The COV(t) of the tabular grain emulsions having a mean tabular grain thickness of greater than 0.07 μm is in all instances less than 15% and, preferably, less than 10%.

For the one ultrathin (t<0.07 μm) tabular grain emulsion that can optionally be present in the multicolor photographic element of the invention reflectance is relatively invariant as a function of the spectral region of scanning, and the utility of the ultrathin tabular grain emulsion does not depend on reflection maxima or minima. Hence there is no need to restrict the COV(t) of the ultrathin emulsion. However, it is, of course, preferred that all of the tabular grains be ultrathin. For example, a preferred ultrathin tabular grain emulsion has tabular grain thicknesses ranging from 0.06 μm the preferred maximum ultrathin tabular grain thickness, down to the minimum achievable tabular grain thickness, typically 0.02 or 0.03 μm.

In forming tabular grain emulsions satisfying the <15% and <10% COV(t) parameters discussed above the grain population as initially precipitated will in many instances exhibit both a COV(t) and COV(ECD) of <15% or <10%. It is well understood in photography that as COV(ECD) decreases contrast increases and, of equal importance from a practical utility viewpoint, exposure latitude decreases. That is, the exposure difference (Δ log E) separating maximum and minimum density is reduced. This reduces the photographer's permissible error in exposure selection. To avoid restricted exposure latitude and to control contrast it is preferred that the COV(ECD) of the tabular grain emulsion or emulsions intended to record exposure within the same region of the spectrum be greater than 15%. COV(ECD) ranges of from 20 to 50 percent or higher can be readily accommodated. Achieving a greater COV(ECD) than COV(t) for a tabular grain emulsion can be achieved by blending tabular grains of similar thicknesses and different ECDs. Another approach is to coat a plurality of tabular grain emulsion layers for recording in the same region of the spectrum of similar COV(t). By employing tabular grain emulsions in the different layers of differing ECD the overall COV(ECD) of the tabular grain emulsions recording in the same region of the spectrum can be extended to the extent desired to provide increased exposure latitude and reduced contrast.

To permit distinguishable differences between reflectances in different tabular grain emulsions it is essential that there be some minimum difference between their mean tabular grain thicknesses. In the multicolor photographic elements of the invention it is contemplated that each tabular grain emulsion intended to record exposure in one region of the spectrum exhibit a mean tabular grain thickness that differs by at least 0.02 μm and, preferably, at least 0.04 μm from the mean thickness of the tabular grains in each remaining tabular grain emulsion intended to record exposure to a different region of the spectrum.

The basic features of the invention can be appreciated by considering the construction and use of a multicolor photographic element satisfying the requirements of the invention capable of forming on imagewise exposure and processing three different spectral image records satisfying Structure I:

| Structure I |
|---|
| 1st Recording Layer Unit |
| 2nd Recording Layer Unit |
| 3rd Recording Layer Unit |
| Photographic Support |

The first, second and third recording layer units are chosen to each record photographically exposure to a different one of the blue, green and red portions of the visible spectrum. Assigning the following descriptors:

B=blue recording layer unit,

G=green recording layer unit,

R=red recording layer unit, and

S=support, the following layer order sequences are contemplated: B/G/R/S, B/R/G/S, G/R/B/S, R/G/B/S, G/B/R/S and R/B/G/S. Kofron et al U.S. Pat. No. 4,439,520 has demonstrated that adequate separation of blue and minus blue (green or red) can be achieved with tabular grain silver bromide or bromoiodide emulsions without protecting the minus blue recording layer units from blue light exposure. Nevertheless, for increased separation of the blue and minus blue exposure records, the B/G/R/S and B/R/G/S coating sequences are preferred when employing tabular grain silver bromide or bromoiodide emulsions, since this sequence allows a blue absorber to be interposed between the B and the underlying G and R recording layer units in an interlayer or to be incorporated directly in the underlying G and/or R recording layer units. The blue absorber does not interfere with subsequent scanning, since conventional blue absorbers are routinely removed or decolorized during photographic processing. When the tabular grain emulsions are silver chloride, the negligible native sensitivity of silver chloride effectively eliminates blue exposure contamination of minus blue (green or red) recording layer units, regardless of the layer order chosen and without employing a blue absorber. When using silver chloride tabular grain emulsions, a specifically preferred arrangement is G/R/B/S, since this places the green recording layer unit that produces the visually most important record in the most favored position for exposure and the red recording layer unit that produces the next visually most important record in the next most favored location for exposure.

Each of the blue, green and red recording layer units can consist of a single tabular grain emulsion layer and that layer can contain a single tabular grain emulsion or a blended combination of tabular grain emulsions differing in mean ECD to obtain a selected exposure latitude and contrast, but of essentially the same mean tabular grain thickness. Alternatively the different tabular grain emulsions within a single recording layer unit can be coated in separate layers. Usually, the faster (larger ECD) tabular grain emulsion is positioned to receive exposing light before the slower (smaller ECD) tabular grain emulsion, but reverse order of coating is also known to offer photographic advantages for some applications.

In Structure I above the first and second recording layer units are preferably selected to contain tabular grains having a mean thickness of >0.07 μm. That is the tabular grains in these recording layer units preferably exhibit reflectance maxima and minima within the overall scanning range of from 300 to 900 nm.

It is also possible for the third recording layer unit to contain tabular grain having a mean thickness of >0.70 μm, although this is not preferred. Since the spectral frequency of reflectance variance is low, it is difficult to accommodate three different recording layer unit reflectance maxima within the overall scanning range of from 300 to 900 nm and, at a wavelength where reflectance is at a maximum for one recording layer unit, to realize also minimal reflectances for the remaining two recording layer units.

The preferred choice is for the third recording layer unit to contain ultrathin tabular grains. Although it is possible to choose any one of the first, second and third recording layer units to contain the ultrathin tabular grains, the third recording layer unit is the preferred location for ultrathin tabular grains. The reason for this is that the ultrathin tabular grains exhibit reflectances over a broad spectral band. Locating the third recording layer unit nearest the support eliminates unwanted reflections from the ultrathin tabular grains during imagewise exposure that would occur if the ultrathin tabular grains were located in either of the first or second recording layer units. There is also an advantage in scanning to have the ultrathin tabular grains in the recording layer unit coated nearest the support.

In Table I specific illustrations are provided of mean tabular grain thickness selections (t-1, t-2 and t-3) for the first, second and third recording layer units (RLU-1, RLU-2 and RLU-3), respectively, and corresponding scanning wavelengths (Scan-1, Scan-2 and Scan-3) to observe reflectance from each of these recording layer units.

TABLE I

| RLU-1 | | RLU-2 | | RLU-3 | |
|---|---|---|---|---|---|
| t-1 (μm) | Scan-1 (nm) | t-2 (μm) | Scan-2 (nm) | t-3 (μm) | Scan-3 (nm) |
| 0.08 | 650 | 0.13 | 420 | <0.06 | 500 |
| 0.09 | 700 | 0.14 | 440 | <0.06 | 530 |
| 0.10 | 710 | 0.15 | 470 | <0.06 | 575 |
| 0.11 | 715 | 0.16 | 500 | <0.06 | 605 |
| 0.12 | 720 | 0.18 | 570 | <0.06 | 640 |

The tabular grain thickness selections discussed above are based on achieving desired reflectances during scanning of the imagewise exposed and processed multicolor photographic element. In each occurrence the first and second recording layer unit mean tabular grain thickness and scanning wavelength selections can be exchanged. Further, these selections have been made entirely independent of any assumptions as to which of the recording layer units will record imagewise exposure to a selected (blue, green or red) region of the spectrum. Stated another way, these mean tabular grain thickness selections are entirely independent of exposure wavelengths the tabular grains are intended to record.

If it is assumed that Structure I contains silver bromide or bromoiodide emulsions that would benefit from being shielded from blue light while recording minus blue light and it is further assumed that the conventional B/G/R/S coating sequence is chosen, it is then possible to adjust the selections of mean tabular grain thicknesses both to achieve the scanning capabilities required by this invention and to increase the reflection of blue light by the first (blue) recording layer unit to minimize blue light exposure of the underlying recording layer units. With these assumptions the RLU-1 and RLU-2 mean tabular grain selections in Table I are preferably reversed to reduce blue exposure of the underlying minus blue recording layer units.

While the characteristics of preferred multicolor photographic elements satisfying the requirements of the invention have been described by referring to Structure I, it is appreciated that three separate recording layer units, although preferred, are not required for the practice of the invention. It is possible to eliminate any one of the first, second and third recording layer units from Structure I and to have remaining a multicolor photographic element satisfying the requirements of the invention. It is also possible to blend together in one layer unit any combination of the emulsions in first, second and third recording layer units to produce a structure having one or two recording layer units. The following are intended to provide specific, non-limiting illustrations of alternative structures:

Structure II

1st Recording Layer Unit
2nd Recording Layer Unit
Photographic Support

Structure III

Combined 1st and 2nd Recording Layer Units
3rd Recording Layer Unit
Photographic Support
and Structure IV Combined 1st, 2nd and 3rd Recording Layer Units
Photographic Support Following imagewise exposure the multicolor photographic elements of the invention are developed to produce a silver image pattern in each recording layer unit and a complementary image pattern consisting of the tabular silver halide grains that were not developed. Any convenient conventional black-and-white development process can be employed. The formation of a dye image is neither required nor preferred. Since developed silver ($Ag^{\circ}$) is not needed in the developed element and since its broad band light absorption actually degrades image information retrieval by scanning, the next step is to remove the developed silver from the element. This can be achieved by employing any conventional photographic bleaching solution that does not also remove silver halide (i.e., bleach-fix or fix solutions are excluded) and does not rely on rehalogenation for bleaching. An exemplary bleach solution of this type is disclosed in the examples below.

Since silver halide grains remain in the photographic element after processing, consideration must be given to printout (silver halide reduction to $Ag^{\circ}$) during subsequent handling. Adequate protection from printout is afforded simply by avoiding unnecessary exposure of the photographic element to ambient light prior to scanning. Scanning itself can be completed before the image information is degraded by light exposure. It is, of course, possible to introduce into the emulsions during processing one or more conventional desensitizers or stabilizers to provide further protection against printout, but this is not essential.

Once photographic processing is completed three tabular grain image patterns remain in the multicolor photographic element that can be retrieved by scanning. The processed photographic element can be scanned using conventional transmission or reflectance scanning techniques.

When image information is intended to be retrieved from the photographic element by reflectance scanning, the support of the photographic element is preferably constructed to exhibit minimal reflectance to the scanning beams. This can be achieved by incorporating an absorber in a film base or by coating an absorbing layer on the film base. For example, the film base or a coating on the film base and forming a part of the support can be conveniently constructed to be black. A black pigment, such as carbon, or a combination of dyes for absorbing within the scanning wavelengths can be used. Unlike conventional antihalation layers that are also black, but are especially constructed to decolorize during photographic processing, preferred supports for reflection scanning retain their light absorbing properties after processing. A support constructed for reflection scanning as described above is capable of also performing the function of conventional antihalation layers. When the photographic element is reflection scanned, the light reflected back to the scan sensor from each pixel addressed on the element is recorded. The information content is the difference between minimum reflectance in areas containing no tabular grains after processing and the reflectance actually observed.

When the processed photographic element is intended to be transmission scanned, the support must be transparent following processing. The support in this instance preferably includes a conventional antihalation layer that is decolorized during processing. When the photographic element is transmission scanned, the light transmitted through the photographic element to the scan sensor is recorded. The information content is the difference between maximum transmission in areas containing no tabular grains after processing and the transmission actually observed.

While Table I identifies a single wavelength for obtaining information from each of the three different recording layer units, it is appreciated that each channel of scanning information can extend over a relatively broad band of wavelengths, since the spectral frequency of reflectance variance is low. Scanning band widths of up to 50 nm or more are contemplated as being practical, although scanning band widths are preferably less than 25 nm. The wavelengths provided in Table I can be viewed as the average wavelength within the bandwidth used for scanning. Laser scanning, of course, allows narrow scanning bandwidths.

Conventional scanning techniques satisfying the requirements described above can be employed and require no detailed description. It is possible to successively scan the photographic element within each of the wavelength ranges discussed above or to combine in one beam the different wavelengths and to resolve the combined beam into separate image records by passing different portions of the beam through separate filters which allow transmission within only the spectral region corresponding to the image record sought to be formed. A simple technique for scanning is to scan the photographically processed element point-by-point along a series of laterally offset parallel scan paths. The intensity of light reflected from or passing through the photographic element at a scanning point is noted by a sensor which converts radiation received into an electrical signal. The electrical signal is passed through an analogue to digital converter and sent to memory in a digital computer together with locant information required for pixel location within the image. Signal adjustments to eliminate superimposed signals, as occur when an ultrathin tabular grain emulsion is employed, or to eliminate known image distortions, illustrated in the Examples below, can be easily performed on the computer stored sensing data.

Once the image records corresponding to the latent images have been obtained, the original image or selected variations of the original image can be reproduced at will. The simplest approach is to use lasers to expose pixel-by-pixel a conventional color paper. Simpson et al U.S. Pat. No. 4,619,892 discloses differentially infrared sensitized color print materials particularly adapted for exposure with near infrared lasers. Instead of producing a viewable hard copy of the original image the image information can instead be fed to a video display terminal for viewing or fed to a storage medium (e.g., an optical disk) for archival storage and later viewing.

One of the challenges encountered in producing images from information extracted by scanning is that the number of pixels of information available for viewing is only a fraction of that available from a comparable classical photographic print. It is therefore even more important in scan imaging to maximize the quality of the image information available from each pixel. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. Although the invention is described in terms of point-by-point scanning, it is appreciated that conventional approaches to improving image quality are contemplated. Illustrative systems of scan signal manipulation, including techniques for maximizing the quality of image records, are disclosed by Bayer U.S. Pat. No. 4,553,165, Urabe et al U.S. Pat. No. 4,591,923, Sasaki et al U.S. Pat. No. 4,631,578, Alkofer U.S. Pat. No. 4,654,722, Yamada et al U.S. Pat. No. 4,670,793, Klees U.S. Pat. No. 4,694,342, Powell U.S. Pat. No. 4,805,031, Mayne et al U.S. Pat. No. 4,829,370, Abdulwahab U.S. Pat. No. 4,839,721, Matsunawa et al U.S. Pat. Nos. 4,841,361 and 4,937,662, Mizukoshi et al U.S. Pat. No. 4,891,713, Petilli U.S. Pat. No. 4,912,569, Sullivan et al U.S. Pat. No. 4,920,501, Kimoto et al U.S. Pat. No. 4,929,979, Klees U.S. Pat. No. 4,962,542, Hirosawa et al U.S. Pat. No. 4,972,256, Kaplan U.S. Pat. No. 4,977,521, Sakai U.S. Pat. No. 4,979,027, Ng U.S. Pat. No. 5,003,494, Katayama et al U.S. Pat. No. 5,008,950, Kimura et al U.S. Pat. No. 5,065,255, Osamu et al U.S. Pat. No. 5,051,842, Lee et al U.S. Pat. No. 5,012,333, Sullivan et al U.S. Pat. No. 5,070,413, Bowers et al U.S. Pat. No. 5,107,346, Telle U.S. Pat. No. 5,105,266, MacDonald et al U.S. Pat. No. 5,105,469, and Kwon et al U.S. Pat. No. 5,081,692, the disclosures of which are here incorporated by reference.

The multicolor photographic elements and their photographic processing, apart from the specific required features described above, can take any convenient conventional form. A summary of conventional photographic element features as well as their exposure and processing is contained in *Research Disclosure*, Vol. 308, December 1989, Item 308119, and a summary of tabular grain emulsion and photographic element features and their processing is contained in *Research Disclosure*, Vol. 225, December 1983, Item 22534, the disclosures of which are here incorporated by reference.

These disclosures are not, however, relied upon for a teaching of the tabular grain emulsions required for the practice of the invention. Ultrathin tabular grain emulsions satisfying the requirements of the invention are disclosed by Daubendiek et al U.S. Pat. Nos. 4,414,310, 4,672,027 and 4,693,964; Zola and Bryant European published application 362699 A3; and Antoniades et al European published application 507701 A1, while tabular grain emulsions having mean tabular grain thicknesses of $>0.07$ μm are disclosed by Nakamura et al U.S. Pat. No. 5,096,806 and Tsaur et al U.S. Pat. Nos. 5,147,771, 5,147,772, 5,147,773 and 5,171,771, the disclosures of which are here incorporated by reference.

When emulsions intended to record exposures to two or three different spectral wavelength regions are incorporated in the same layer of a photographic element according to the invention, the same blending procedures can be employed as in blending emulsions sensitized to the same region of the spectrum, provided spectral sensitizing dyes are employed that remain adsorbed to the grain surfaces. Locker U.S. Pat. No. 3,989,527, here incorporated by reference, demonstrates the capability of those skilled in the art to select spectral sensitizing dyes that remain adsorbed to a selected silver halide grain population after another grain population has been blended. Although the present invention does not rely on dye-forming couplers for imaging, when blending emulsions intended to record exposures to different spectral regions, procedures can be employed that have been developed for blending emulsions sensitized to different spectral regions and containing different dye-forming couplers. Illustrations of blended emulsions, including "multi-packet" emulsions, are illustrated by Mannes et al U.S. Pat. No. 2,186,940, Godowski U.S. Pat. Nos. 2,548,526, 2,698,794 and 2,843,488, Van Campen et al U.S. Pat. No. 2,763,552, Dann et al U.S. Pat. No. 2,831,767, Caldwell U.S. Pat. No. 2,956,884 and Schranz et al U.S. Pat. No. 4,865,940, the disclosureof which are here incorporated by reference.

EXAMPLES

The invention can be better appreciated by reference to the following specific examples. Example films were prepared as described below. Coating densities, set out in brackets ([]) are reported in terms of grams per square meter, g/m$^2$, except as specifically noted. Silver halide coverages are reported in terms of silver.

EXAMPLE 1

Emulsion A (AKT-945)

Into a reaction vessel was placed an aqueous gelatin solution (composed of 1 liter of water, 0.6 g of oxidized bone gelatin, 4.2 ml of 4N nitric acid solution, 37.8 wt %, based on total silver introduced in nucleation, of PLURONIC-31R1 TM, a polyalkylene oxide block copolymer surfactant satisfying formula II, x=25, x'=25, y=7, of Tsaur et al U.S. Pat. No. 5,147,771, and an appropriate amount of sodium bromide to adjust the pAg of the vessel to 9.27). While keeping the temperature thereof at 45° C. and the pAg at 9.27, 3.3 ml of an aqueous solution of silver nitrate (containing 0.28 g of silver nitrate) and an aqueous solution of sodium bromide were simultaneously added thereto over a period of 1 minute at a constant rate. After 1 minute of mixing, the pAg of the vessel was adjusted to 9.70 with a 1.0M sodium bromide aqueous solution. The temperature of the mixture was subsequently raised to 60° C. over a period of 9 minutes. At that time, 8.5 ml of an aqueous ammonia solution (containing 2.53 g of ammonia sulfate and 21.9 ml of 2.5N sodium hydroxide solution) were added to the vessel and mixing was conducted for a period of 9 minutes. Thereafter, 250 ml of an aqueous gelatin solution (containing 25 g of oxidized bone gelatin, 0.017 g of PLURONIC-31R1 TM, and 7.7 ml of 4N nitric acid solution) were added to the mixture over a period of 4 minutes. Subsequently, 50 ml of an aqueous silver nitrate solution (containing 4.24 g of silver nitrate) and 53 ml of an aqueous sodium bromide solution (containing 2.95 g of sodium bromide) were added at a constant rate for a period of 20 minutes. Then, 487.5 ml of an aqueous silver nitrate solution (containing 132.5 g of silver nitrate) and 485 ml of an aqueous sodium bromide solution (containing 83.8 g of sodium bromide) were simultaneously added to the aforesaid mixture at constant ramp starting from a respective rate of 1.5 ml/min and 1.58 ml/min for the subsequent 75 minutes. Then, 232.7 ml of an aqueous silver nitrate solution (containing 63.3 g of silver nitrate) and 230.7 ml of an aqueous sodium bromide solution (containing 39.8 g of sodium bromide) were simultaneously added to the aforesaid mixture at a constant rate over a period of 20.2 minutes. The silver halide emulsion thus obtained was washed. The emulsion grains were substantially all tabular grains (i.e., tabular grain projected area accounted for >97% of total grain projected area). The properties of grains of this emulsion were as follows:

Average Size (ECD): 2.30 μm
Average Thickness (t): 0.110 μm
Aspect Ratio (ECD:t): 20.9
Average Tabularity (ECD/t$^2$): 190.1
COV (ECD): 8.1%
COV(t): 10.5%

Emulsion B (AKT1091)

In a reaction vessel was placed an aqueous gelatin solution (composed of 1 liter of water, 0.5 g of oxidized bone gelatin, 4.2 ml of 4N nitric acid solution, 46.7 wt %, based on total silver introduced in nucleation, of PLURONIC-31R1 TM and an appropriate amount of sodium bromide to adjust the pAg of the vessel to 9.14). While keeping the temperature thereof at 45° C. and the pAg at 9.14, 2.7 ml of an aqueous solution of silver nitrate (containing 0.23 g of silver nitrate) and an aqueous solution of sodium bromide were simultaneously added thereto over a period of 1 minute at a constant rate. After 1 minute of mixing, the pAg of the vessel was adjusted to 9.70 with a 1.0M sodium bromide aqueous solution. The temperature of the mixture was subsequently raised to 60° C. over a period of 9 minutes. At that time, 38.3 ml of an aqueous ammonia solution (containing 2.53 g of ammonia sulfate and 21.7 ml of 2.5N sodium hydroxide solution) were added to the vessel and mixing was conducted for a period of 9 minutes. Thereafter, 257.5 ml of an aqueous gelatin solution (containing 16.7 g of oxidized bone gelatin, 0.017 g of PLURONIC-31R1 TM and 7.5 ml of 4N nitric acid solution) were added to the mixture over a period of 2 minutes. Subsequently, 100 ml of an aqueous silver nitrate solution (containing 8.5 g of silver nitrate) and 101.3 ml of an aqueous sodium bromide solution (containing 5.63 g of sodium bromide) were added at a constant rate for a period of 40 minutes. Then, 474.7 ml of an aqueous silver nitrate solution (containing 129.0 g of silver nitrate) and 467.2 ml of an aqueous sodium bromide solution (containing 484.4 g of sodium bromide) were simultaneously added to the aforesaid mixture at a constant ramp starting from a respective rate of 1.5 ml/min and 1.52 ml/min for the subsequent 64 minutes. Then, 226.7 ml of an aqueous silver nitrate solution (containing 61.6 g of silver nitrate) and 223.3 ml of an aqueous sodium bromide solution (containing 38.6 g of sodium bromide) were simultaneously added to the aforesaid mixture at a constant rate over a period of 17 minutes. The silver halide emulsion thus obtained was washed. The emulsion grains were substantially all tabular grains (i.e., tabular grain projected area accounted for >97% of total grain projected area). The properties of grains of this emulsion are as follows:

Average Size (ECD): 2.10 μm
Average Thickness (t): 0.169 μm
Aspect Ratio (ECD:t): 12.4
Average Tabularity (ECD/t$^2$): 73.5

COV(ECD): 5.8%
COV(t): 9.6%

SENSITIZATION

Each mole of emulsion A was optimally sensitized by adding the following chemicals sequentially: 4.6 mg of potassium tetrachloroaurate, 181 mg of sodium thiocyanate, 510 mg of the green absorbing spectral sensitizing dye 5,6'-dichloro-3,3'-diethyl-5',6-di(trifluoromethYl)-1,1'-di(3-sulfopropyl)benzimidazolium carbocyanine, sodium salt, 20 mg of anhydro-5,6-dimethyl-3(3-sulfopropyl)benzo-thiazolium, 4.6 mg of sodium thiosulfate pentahydrate, 0.5 mg of potassium selenocyanate, heat treated at 65° C. for 26 min, and 2300 mg/mole of 5-methyl-s-triazole-(2-3-a)-pyrimidine-7-ol.

Each mole of emulsion B was optimally sensitized by adding the following chemicals sequentially: 4.2 mg of potassium tetrachloroaurate, 135 mg of sodium thiocyanate, 300 mg of the blue absorbing spectral sensitizing dye 3-carboxymethyl-5-[3-(4-sulfobutyl)-2(3H)-thiazolinylidene)]-rhodanine and triethylamine (1:1), 18 mg of anhydro-5,6-dimethyl-3-(3-sulfopropyl)benzothiazolium inner salt, 4.2 mg of sodium thiosulfate pentahydrate, 0.54 mg of potassium selenocyanate, heat treated at 65° C. for 31 min, and 1600 mg/mole of 5-methyl-s-triazole-(2-3-a)-pyrimidine-7-ol.

A film was prepared by coating the following layers in the order named on a transparent cellulose triacetate film base.

Layer 1
Green Recording Layer Unit (G-1)
Gelatin [1.6];
Green sensitive silver bromide emulsion A [1.07].
Layer 2
Interlayer
Gelatin [1.6];
Yellow filter dye 4-[p-(butylsulfonamido)-phenyl]-3-cyano-5- (2-furylmethine )-2-oxo-2,5-dihydrofuran [0.2].
Layer 3
Blue Recording Layer Unit ( B- 1)
Gelatin [1.6];
Blue sensitive silver bromide emulsion B [1.07].
Layer 4
Supercoat
Gelatin [0.7];
Bis (vinylsulfonylmethyl) ether [0.008].

Every emulsion-containing layer contained 4-hydroxy-6-methyl-1,3,3a, 7-tetraazaindene, sodium salt, at 2.3 g per mole of silver Surfactants were also used to aid in coating.

Samples of the coated film were exposed in a photographic sensitometer using a Daylight balanced light source having a spectral energy distribution approximating a color temperature of 5500° K passed through either a Kodak Wratten TM #98 (blue, transmitting light in the 400 to 500 nm wavelength range), #12 (yellow, transmitting light in the >500 nm range), or a sequential combination of two previous exposures (giving blue, yellow, or blue plus yellow light exposures, respectively) and a graduated density step wedge. The yellow light exposure is hereinafter referred to as green light exposure, since no recording layer unit was sensitized to the red portion of the spectrum and therefore only the green portion of the yellow exposure was of interest. The exposed film samples were processed according to the following procedure:

1. Develop in a hydroquinone-N,N-dimethylaminophenol hemisulfate (specifically, Kodak RP X-OMAT TM ) developer at 35° C. (30 seconds).
2. 3% Acetic acid stop bath (1 minute).
3. Wash (3 minutes).
4. Dichromate bleach (12 g/l sulfuric acid and 9.5 g/l potassium dichromate) (10 minutes).
5. Wash (3 minutes).
6. Clearing bath (10 g/l sodium sulfite) (2 minutes).
7. Wash (2 minutes).
8. Dry film.

The processed film contained an imagewise distribution of undeveloped silver halide emulsion grains that did not form a latent image during exposure. In terms of residual silver halide concentration a positive image was present—i.e., less silver halide was present in areas of the film receiving greater levels of exposure. The silver halide image in each layer had a unique spectral reflectance corresponding to its grain thickness. Reflection spectra for processed coatings of the blue recording layer unit (B-1) and the green recording layer unit (G-1) alone are shown in FIG. 1. By reference to FIG. 1 it can be seen that B-1 reflected primarily blue-green light (peak reflectance at 500 nm) while G-1 reflected primarily magenta light (peak reflectances less than 400 nm and greater than 700 nm). The intensity of the reflected light varied in proportion to the amount of residual silver halide in each layer, more reflection occurring in areas of the film containing more residual silver halide.

Figure 2:
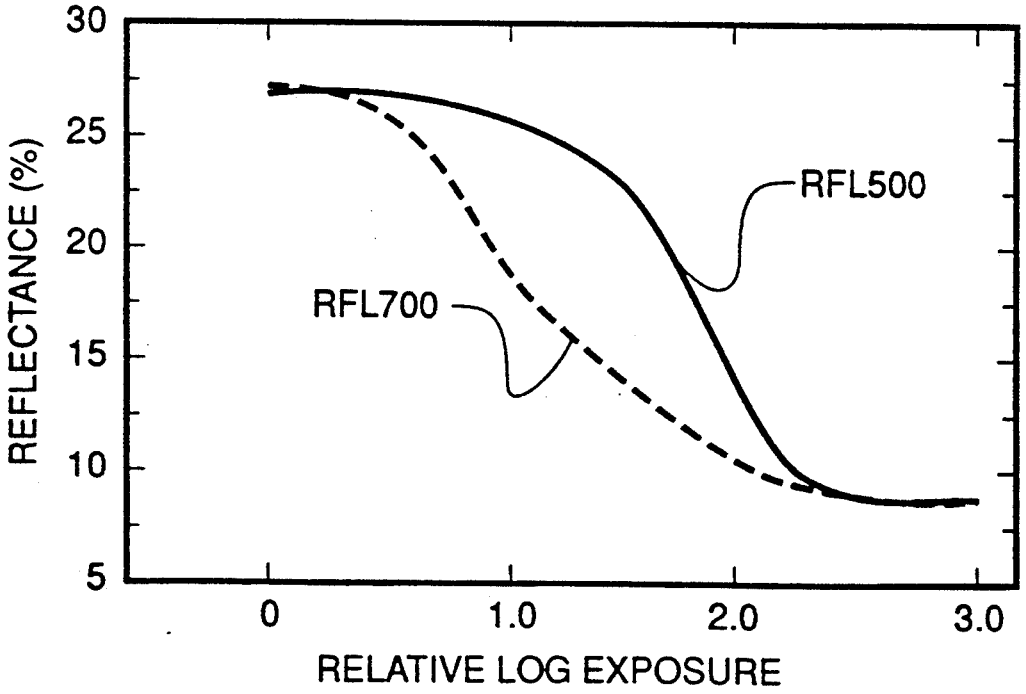
FIGS. 2 to 4 inclusive are plots of 500 nm and 700 nm reflectances in percent versus relative log exposure, where exposure is in each instance measured in meter-candle (lux)-seconds.

The photographic response of the example film represented as plots of total reflectance at 500 nm (RFL500) and 700 run (RFL700) versus the logarithm of input exposure is shown in FIG. 2 for a blue plus green light exposure. Because the film was exposed to blue plus green light, both the blue recording layer unit B-1 and the green recording layer unit G-1 were responding to exposure to produce a photographic image. By comparing FIGS. 1 and 2 it is apparent that RFL500 is providing a photographic characteristic curve that is primarily determined by the residual silver halide in the blue recording layer unit B-1 while RFL700 is providing a photographic characteristic that is primarily determined by the residual silver halide in the green recording layer unit G-1. Hence two distinguishable records of exposure to blue and green light were obtained.

EXAMPLE 2

Figure 3:
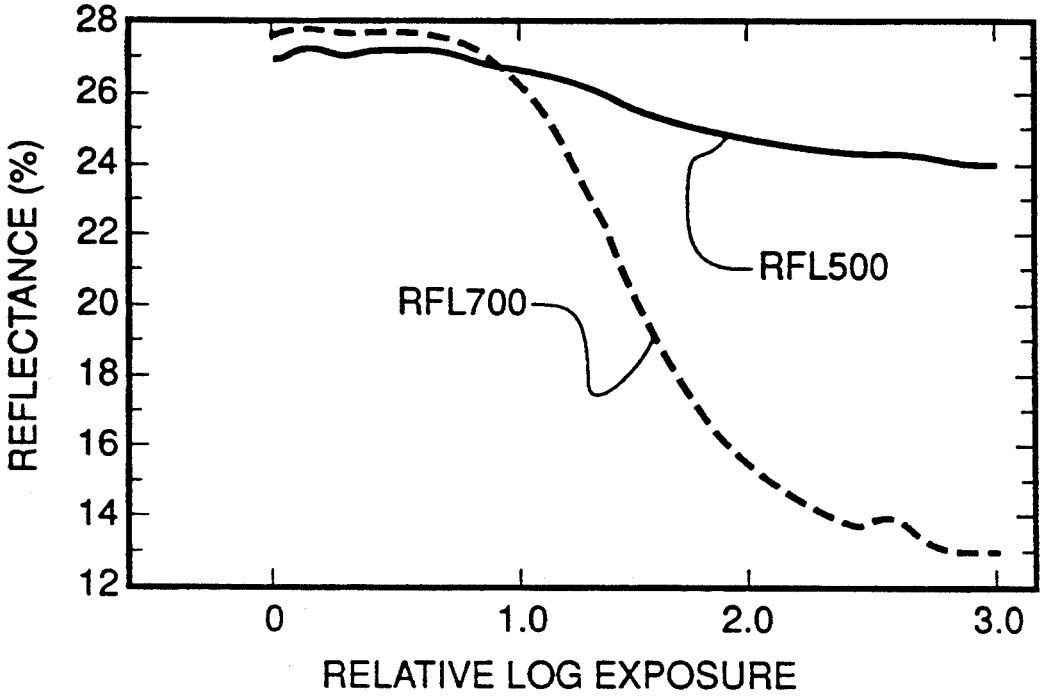
Figure 4:
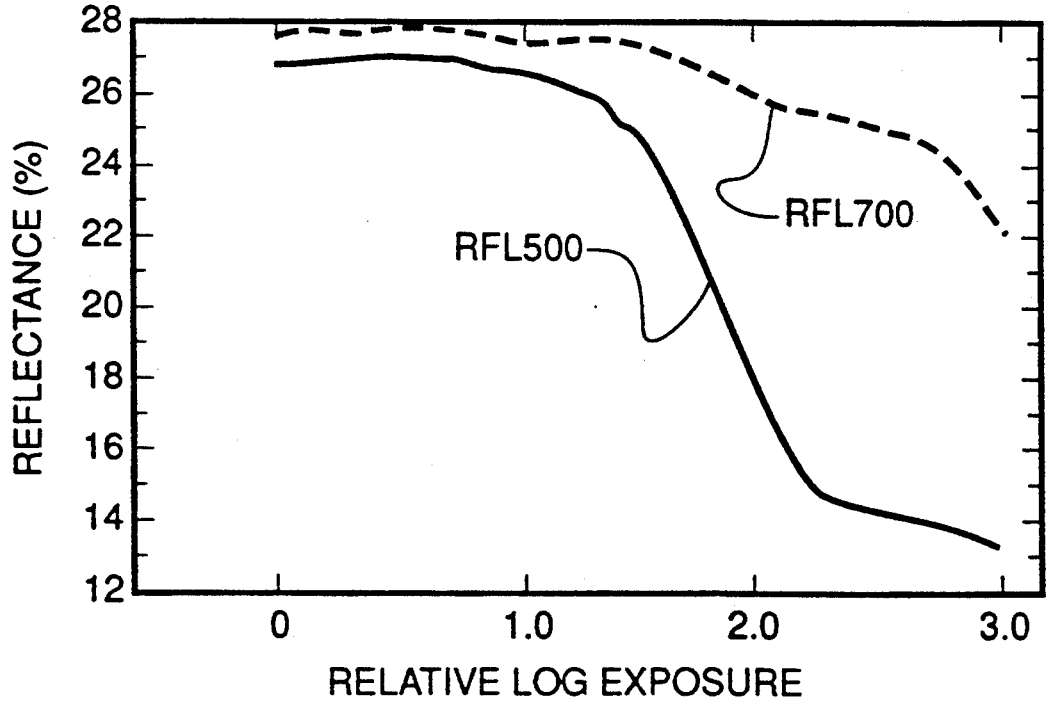

The ability to determine recorded images in the individual layers of the photographic element described above was improved by using the art recognized procedures of analytical color densitometry applied to the measured reflectances. The procedure employed is summarized in James *The Theory of The Photographic Process*, 4th Ed., Macmillan, New York, 1977, Chapter 18, particularly sub-section 2 (b), pp. 524–526. FIGS. 3 and 4 show the measured responses for samples of the film of Example 1 that received green only and blue only exposure, respectively. By reference to the above mentioned figures it can be seen that variations in the recorded image in one recording layer unit produce corresponding variations in the measured response for the other recording layer unit.

Total reflection at 500 nm and 700 nm (RFL500 and RFL700, respectively) was measured for each of three processed film strips (green only, blue only, and blue plus green light exposures) for each level of exposure using a reflection spectrophotometer.

A plot was made of RFL500 versus RFL700 for every exposure level of the green separation exposure. A best fit line satisfying the relationship:

$$RFL500 = a12 \times RFL700$$

was determined either graphically or by standard techniques of linear regression over the range of the plot that was substantially linear. A value of 0.21 was found for a12. For completeness, note that:

$$RFL700 = a11 \times RFL700$$

and that all is necessarily 1.0.

Plots were made of RFL700 verses RFL500 for each exposure level of the blue separation exposure. A best fit line satisfying the relationship:

$$RFL700 = a21 \times RFL500$$

was determined either graphically or by standard techniques of linear regression over the range of the plot that was substantially linear. A value of 0.19 was found for a21. For completeness, note that:

$$RFL500 = a22 \times RFL500$$

and that a22 is necessarily 1.0.

With this information, the blue recording unit response BR (corresponding to the recorded image in the blue recording layer unit) and the green recording unit response GR (corresponding to the recorded image in the green recording layer unit) was determined. Equations analogous to equation 18.5 of James, cited above, page 525, were written as follows:

$$RFL700 = a11(GR) + a12(BR)$$

$$RFL500 = a21(GR) + a22(BR) \quad \text{(Eq. 1)}$$

RFL500 and RFL700 are each known values obtained from measured reflectances. Similarly, the values of the "a" series constants all to a22 are given above. Therefore, two equations are available containing two unknowns, BR and GR, allowing simultaneous solution to derive these responses. When the equations are rearranged to solve for BR and GR, they can be written as follows:

$$GR = b11(RFL700) + b12(RFL500)$$

$$BR = b21(RFL700) + b22(RFL500) \quad \text{(Eq. 2)}$$

where the "b" series of constants replace multiterm expressions each including a combination of the "a" series of constants.

In the measurements reported, the "b" series of constants were found by calculation from the "a" series of constants to be as follows:

b11 = 1.042
b12 = 0.218
b21 = 0.200
b22 = 1.042

Figure 5:
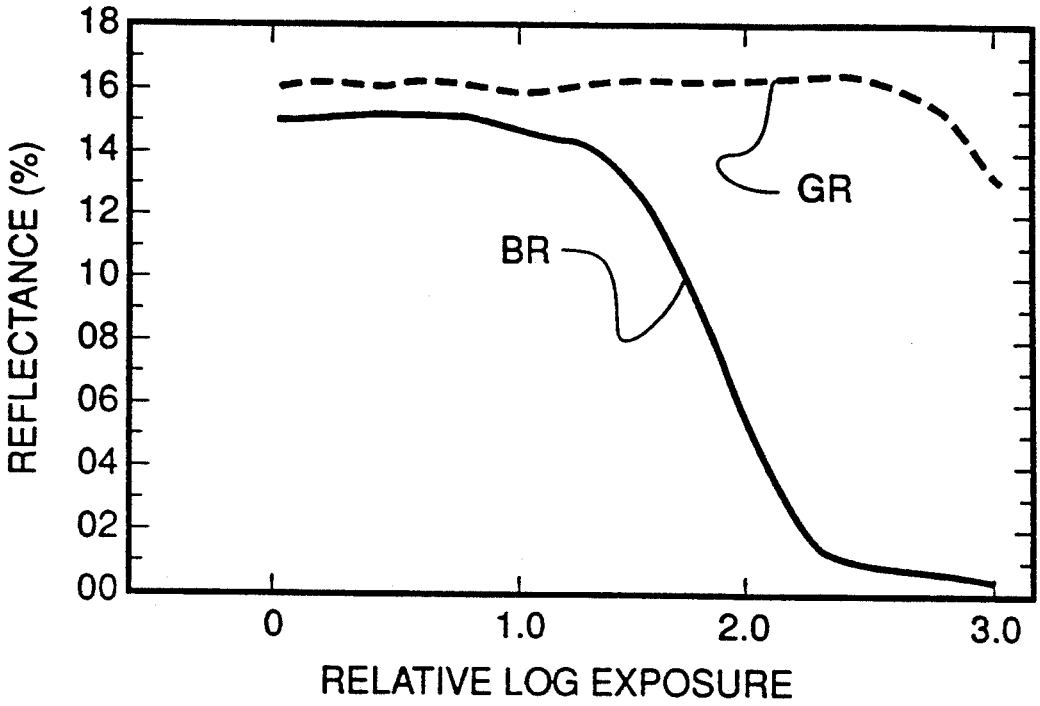
FIGS. 5 to 7 inclusive are plots of green and blue record reflectances in percent versus relative log exposure.
Figure 6:
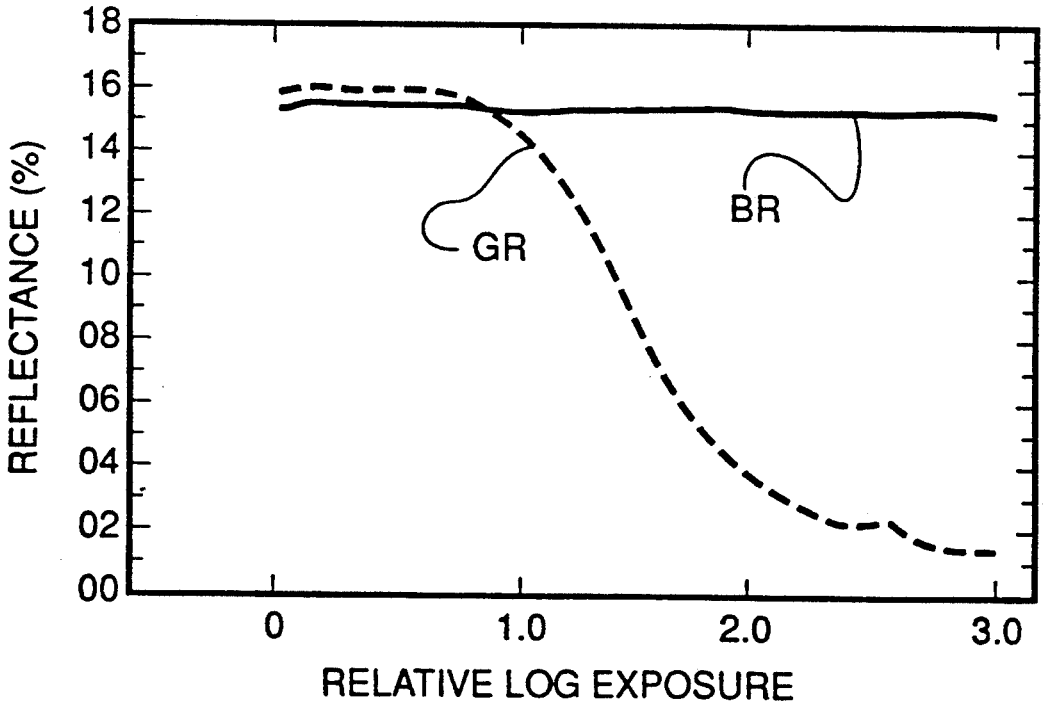

Plots were made of the BR and GR values versus relative log exposure given the film for each type of exposure. FIGS. 5 and 6 show the determined responses for the blue only and green only exposures, respectively. By reference to the above mentioned figures it can be seen that exposure variations in one film recording layer unit produce variations in only the corresponding response measured for the film.

Figure 7:
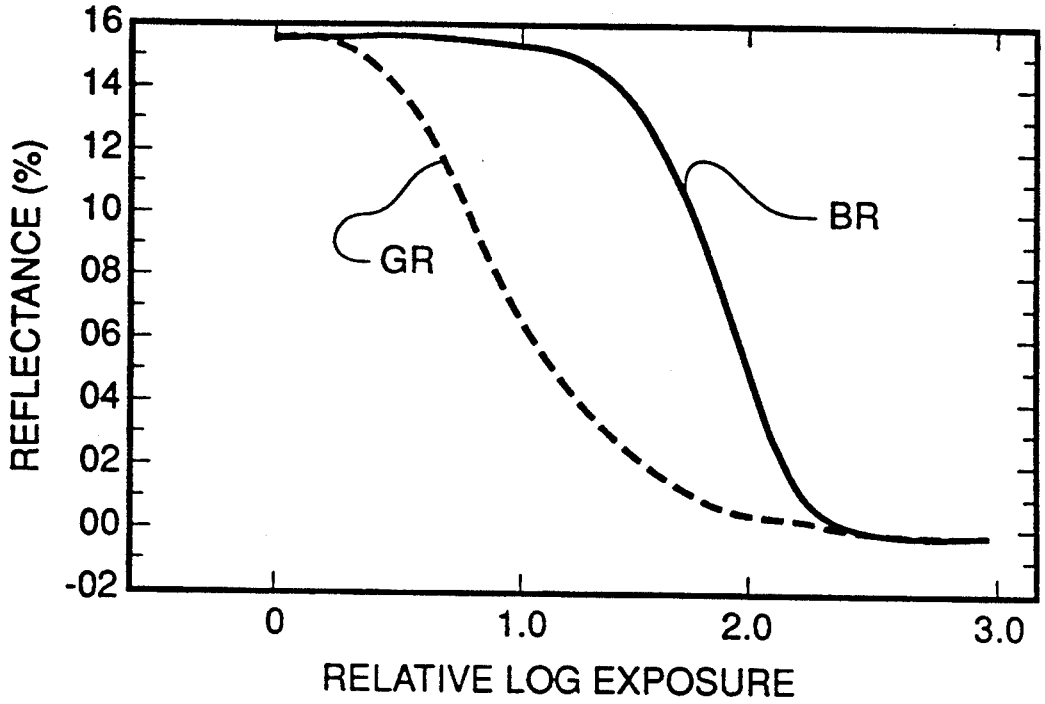

The individual recording layer unit responses for the blue plus green light exposure are shown in FIG. 7. This plot relates input exposure with the film response originating in each individual film record of the photographic element. Measured responses for a new piece of film used to record a photographic scene and photographically processed as described above are useful to drive a digital display yielding a photographic reproduction of the original scene.

EXAMPLE 3

Example 2 was repeated, except that the coating densities of all components in the emulsion containing layers were doubled. Qualitatively similar results were obtained.

EXAMPLE 4

Example 2 was repeated with the exception that the processed film samples were measured in a transmission densitometer having conventional Status M responses. The measured green transmission density (GD) and red transmission density (RD) replaced RFL500 and RFL700, respectively, in Eq. 1 to determine the "a" series constants. The "a" series of constants were found to be as follows:

a11 = 1.0
a12 = 0.676
a21 = 0,617
a22 = 1.0

The "b" series constants were found by calculation from the "a" series of constants to be as follows:

b11 = 1.715
b12 = −1.159
b21 = −1.058
b22 = 1.715

Figure 8:
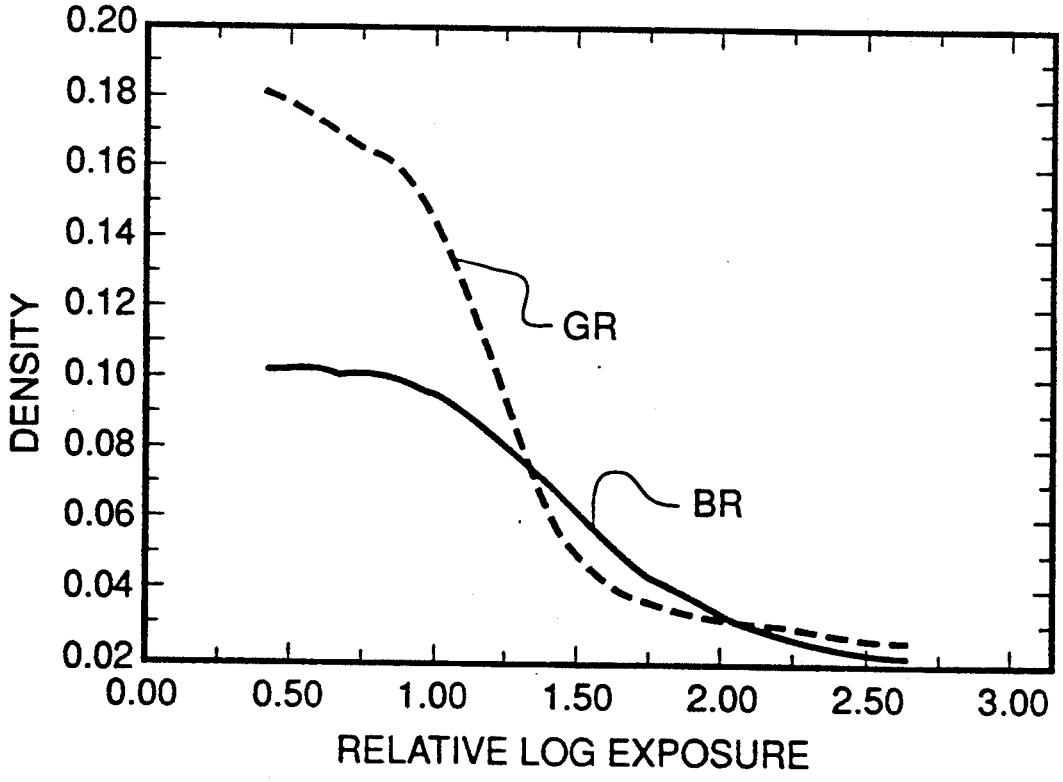
FIG. 8 is a plot of green and blue record transmission densities versus relative log exposure.

The determined responses (BR and GR) for the blue plus green light exposure are shown in FIG. 8 plotted as a function of input exposure.

EXAMPLE 5

A film was prepared by coating the following layers in the order named on a transparent cellulose triacetate film base.

Layer 1
Blue/Green Recording Layer Unit
Gelatin [3.2];
Green sensitive silver bromide emulsion A [1.07].
Blue sensitive silver bromide emulsion B [1.07].
Layer 2
Supercoat
Gelatin [0.7];
Bis (vinylsulfonylmethyl) ether [0. 007 ].

The emulsion-containing layer contained 4-hydroxy-6-methyl-1,3,3a,7-tetraazaindene sodium salt, at 2.3 g per mole of silver. Surfactants were also used to aid in coating.

Figure 9:
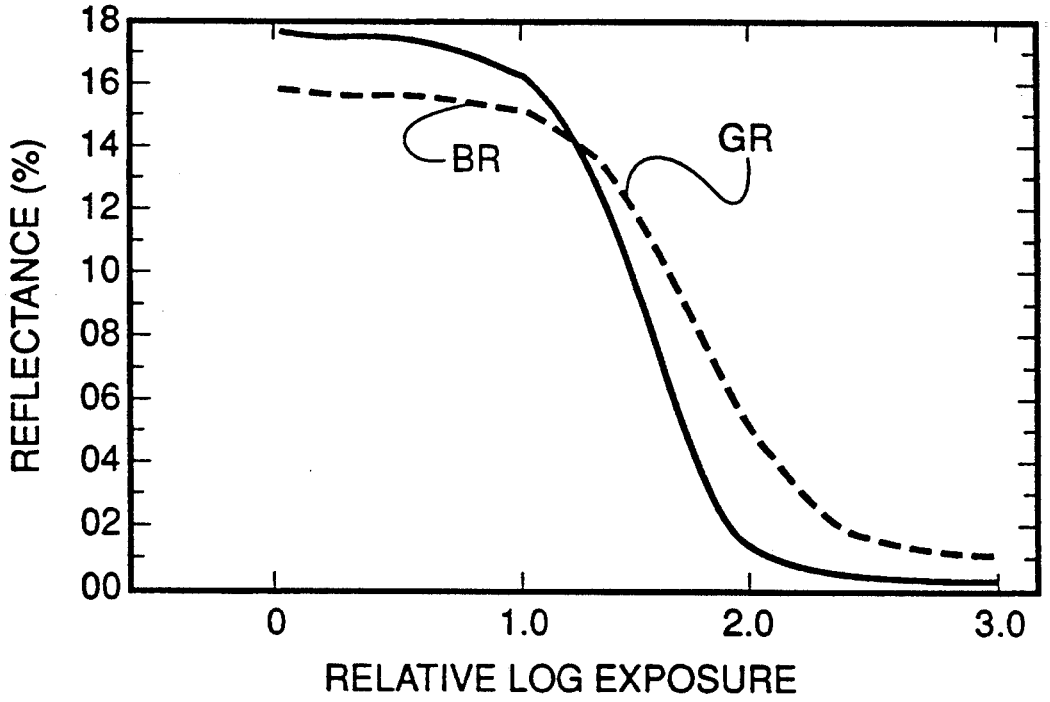
FIG. 9 is a plot of green and blue record reflectances in percent versus relative log exposure.

The coated film was exposed and processed as described above in Example 1. The determined responses for the blue plus green light exposure of the example film are shown in FIG. 9.

The invention has been described in detail with particular reference to preferred embodiments thereof, but it will be understood that variations and modifications can be effected within the spirit and scope of the invention.

What is claimed is:

1. A method of extracting two or more spectral image records from an imagewise exposed multicolor photographic element having a support and, coated on the support, a plurality of tabular silver halide grain emulsions for individually recording imagewise exposure in at least two different regions of the visible spectrum, comprising the steps of (a) photographically processing the imagewise exposed photographic element to produce a detectable image in each tabular grain emulsion that can be spectrally distinguished from the detectable image in all other emulsions for recording in a different region of the spectrum and (b) within the spectral range of from 300 to 900 nm scanning the processed photographic element with electromagnetic radiation in at least two different spectral regions and recording the images observed in the photographic element, wherein (1) in each of the tabular silver halide grain emulsions tabular grain exhibiting a mean equivalent circular diameter of greater than 0.4 micrometer and a mean thickness of less than 0.2 micrometer account for greater than 90 percent of total grain projected area, no more than one of the tabular grain emulsions exhibits a mean tabular grain thickness of less than 0.07 micrometer, each of the remaining tabular grain emulsions exhibit a coefficient of variation of tabular grain thickness of less than 15 percent, and the mean tabular grain thickness of emulsions for recording imagewise exposure to different regions of the visible spectrum differs by at least 0.02 micrometer, (2) during photographic processing the tabular silver halide grain emulsions are developed and Ag° is thereafter removed from the photographic element without removing undeveloped silver halide grains, (3) the processed photographic element is scanned using electromagnetic radiation in a first spectral wavelength region at which the tabular grains in a first of the emulsions reflect to a greater degree than the tabular grain of any emulsion which has recorded imagewise exposure in a different region of the spectrum, (4) the processed photographic element is also scanned using electromagnetic radiation in a second spectral wavelength region within which the tabular grains in a second of the emulsions reflect, and (5) during scanning the intensities of the electromagnetic radiation in the first and second wavelength regions reflected from or transmitted through the photographic element are measured and recorded.

2. A method according to claim 1 wherein the photographic element is sequentially scanned in the first and second wavelength regions.

3. A method according to claim 1 wherein the photographic element is concurrently scanned at the first and second wavelength regions.

4. A method according to claim 1 wherein Ag° is removed from the photographic element during processing using a non-rehalogenating bleaching solution.

5. A method according to claim 1 wherein the tabular grains in each of the emulsions have a means thickness of at least 0.08 micrometer and each of the emulsions is scanned in a selected wavelength region in the range of from 300 to 900 nm to which it exhibits maximum reflectance.

6. A method according to claim 1 wherein the tabular grains in one of the emulsions have a mean thickness of 0.06 micrometer or less and the tabular grains in each of one or more remaining emulsions have a thickness of at least 0.08 micrometer, the one emulsion having tabular grains with a mean thickness of 0.06 micrometer or less is scanned using electromagnetic radiation in a wavelength region in the range of from 300 to 900 nm selected to produce a reflectance from the tabular grains having a means thickness of 0.06 micrometer or less and a minimum combined reflectance from the tabular grains of the one or more remaining emulsions, and the one or more emulsions containing tabular grains having a mean thickness of at least 0.08 micrometer are each scanned using electromagnetic radiation in a wavelength region in the range of from 300 to 900 nm selected to produce essentially maximum reflectance from each of the tabular grain emulsions having a mean tabular grain thickness of at least 0.08 micrometer.

7. A method according to claim 1 wherein the image information obtained by scanning in the first spectral wavelength region is corrected to eliminate a false image component contributed by the emulsions provide to record exposure within a wavelength region differing from that the first emulsion is provided to record and the image information obtained by scanning in the second spectral wavelength region is corrected to eliminate a false image component contributed by the emulsions provided to record exposure within a wavelength region differing from that the second emulsion is provided to record.

8. A method of extracting spectral image records from an imagewise exposed multicolor photographic element having a support and, coated on the support, a red recording tabular silver halide grain emulsion layer unit, a green recording tabular silver halide grain emulsion layer unit, and blue recording tabular silver halide grain emulsion layer unit, comprising the steps of (a) photographically processing the imagewise exposed photographic element to produce a detectable image in each tabular grain emulsion layer unit that can be spectrally distinguished from the detectable image in all other emulsion layer units and (b) within the spectral range of from 300 to 900 nm scanning the processed photographic element using electromagnetic radiation in at least three different spectral regions and recording the images observed in the photographic element, wherein (1) in each of the tabular grain emulsion layer units the tabular grains are comprised of silver bromide or bromoiodide, exhibit a mean equivalent circular diameter of at least 1.0 micrometer, exhibit a tabularity of greater than 25, account for greater than 97 percent of total grain projected area, and exhibit a coefficient of variation of tabular grain equivalent circular diameter of greater than 15 percent, the tabular grains in the emulsion layer unit coated nearest the support exhibit a mean thickness of 0.06 micrometer or less, the tabular grains in each of the two remaining emulsion layer units exhibit a mean thickness in the range of from 0.08 to 0.18 micrometer and exhibit a coefficient of variation of tabular grain thickness of less than 10 percent, and the mean tabular grain thicknesses in each emulsion layer unit differ from those in the remaining emulsion layer units by at least 0.04 micrometer, (2) during photographic processing the tabular silver halide grain emulsions are developed and $Ag^{\circ}$ is thereafter removed from the photographic element without removing undeveloped silver halide grains, (3) the processed photographic element is scanned using electromagnet radiation within a first spectral wavelength region within the range of from 300 to 900 nm selected to permit maximum reflection from the tabular grains in a first of the emulsion layer units exhibiting a mean tabular grain thickness in the range of from 0.08 to 0.18 micrometer, (4) the processed photographic element is scanned using electromagnetic radiation within a second spectral wavelength region within the range of from 300 to 900 nm selected to permit essentially maximum reflection from the tabular grains in a second of the emulsion layer units exhibiting a mean tabular grain thickness in the range of from 0.08 to 0.18 micrometer, (5) the processed photographic element is scanned using electromagnetic radiation within a third spectral wavelength region within the range of form 300 to 900 nm selected to permit reflection from the tabular grains in a third of the emulsion layer units exhibiting a mean tabular grain thickness of 0.06 micrometer or less and a minimum combined reflectance from the two remaining emulsion layer units and (6) during scanning the intensities of the electromagnetic radiation in the first, second, and third wavelength regions reflected from or transmitted through the photographic element are measured and recorded.

* * * * *